US006986915B2

(12) United States Patent
Bourdages

(10) Patent No.: US 6,986,915 B2
(45) Date of Patent: Jan. 17, 2006

(54) METHOD FOR IMPREGNATING MULTI-FILAMENTOUS NET OR MESH WITH PIGMENT FORMULATIONS

(75) Inventor: Richard Bourdages, Repentigny (CA)

(73) Assignee: Champion Consultants Inc., Repentigny (CA)

( * ) Notice: Subject to any disclaimer, the term of this patent is extended or adjusted under 35 U.S.C. 154(b) by 0 days.

(21) Appl. No.: 09/904,044

(22) Filed: Jul. 12, 2001

(65) Prior Publication Data

US 2001/0041220 A1 Nov. 15, 2001

Related U.S. Application Data

(63) Continuation of application No. 09/352,741, filed on Jul. 14, 1999, now abandoned.

(30) Foreign Application Priority Data

Jul. 14, 1998 (CA) ..... 2243189
Apr. 14, 1999 (CA) ..... 2269044

(51) Int. Cl.
*B05D 1/28* (2006.01)
*B05D 1/32* (2006.01)
*D03D 25/00* (2006.01)

(52) U.S. Cl. ..... 427/256; 427/282; 427/288; 427/428; 428/195; 428/245; 428/262; 160/345

(58) Field of Classification Search ..... 427/256, 427/288, 282, 428, 429; 428/187, 190, 195, 428/245, 262; 160/345
See application file for complete search history.

(56) References Cited

U.S. PATENT DOCUMENTS

| | | | | |
|---|---|---|---|---|
| 1,567,384 | A | | 12/1925 | Rectenwald et al. |
| 3,810,616 | A | | 5/1974 | Murphy |
| 3,967,026 | A | | 6/1976 | Dalblom |
| 4,254,952 | A | | 3/1981 | Playter, Jr. |
| 4,547,406 | A | | 10/1985 | Armstrong |
| 4,673,609 | A | | 6/1987 | Hill |
| 5,427,381 | A | | 6/1995 | Macaluso et al. |
| 5,518,803 | A | * | 5/1996 | Thomas |
| 5,680,893 | A | * | 10/1997 | Neer |

FOREIGN PATENT DOCUMENTS

| | | | |
|---|---|---|---|
| GB | 2 165 292 | * | 4/1986 |
| GB | 2291835 A | | 2/1996 |
| NL | 8902666 | | 5/1991 |

OTHER PUBLICATIONS http://www.backoncampus.com/Schools/Alabama/Champion/practice_jersey.htm (p. 1), no date.
http://www.customjersey.com/crest.thlm (p. 1–8), No date.
http://www.packerproshop.com/product.phtml?id=411 (p. 1), No definitive date.

* cited by examiner

*Primary Examiner*—Fred J. Parker
(74) *Attorney, Agent, or Firm*—Fish & Richardson P.C.

(57) ABSTRACT

A pigment formulation and its method of application to multi-filamentous net or mesh to generate an image that is visible from only one side of the multi-filamentous net or mesh is provided. The pigment formulation may comprise of either a paint or an ink composition, which is applied manually onto multi-filamentous nets or mesh.

8 Claims, No Drawings

METHOD FOR IMPREGNATING MULTI-FILAMENTOUS NET OR MESH WITH PIGMENT FORMULATIONS

CROSS-REFERENCE TO RELATED APPLICATION

This is a continuation of application Ser. No. 09/352,741 filed 14 Jul. 1999, now abandoned.

FIELD OF THE INVENTION

The present invention generally relates to a formulation of pigments and its method of application to multi-filamentous netting or mesh materials to generate an image that is visible from only one side and the finished product

BACKGROUND OF THE INVENTION

One of the challenges facing many businesses is to obtain public exposure of its products and/or services. To this end, businesses have used all forms of advertisements to ensure that the public is familiar with their name or product. Due to the overall popularity of sports, it is common to find advertisements associated with sporting events.

Examples of popular sports include hockey, soccer, tennis, football among others. These sports are well known in many countries and the games are often enjoyed at both a professional and at a recreational level. In the case of most public sporting events, companies have long recognized the benefit of locating advertisements directly in the viewing area to increase public exposure of the company's name or product. Commercial signage incorporated in the viewing area and/or the playing surface of the event also provides a sponsor effective exposure during any televised coverage of the event along with any clips or photographs of the event used in electronic or print media.

Presently, the dasher boards surrounding a playing area or track, the score board, the finishing line and the playing field itself, are several examples of common areas used to display advertisements. Prices for advertising in/on these spaces vary according to the likelihood of their exposure on television or in pictures. As such, the space located at key areas tends to command the highest prices.

However, there are several notable shortcomings associated with the use of the above mentioned areas for advertisements. The first is that they are often obscured or cropped out in most media photographs since photographers tend to focus primarily on the players. Secondly, given that advertisers do not have access to the same advertising opportunities normally found with professional leagues in recreational sporting venues, advertisers must find other means to promote their products when working outside a professional sports setting.

Given the importance of a substantial advertising inventory as a source of revenue for professional sports teams and event organizers, and the need to effectively capture the viewing public's attention there is always a need to develop new advertising possibilities. Since netting material is extensively used in numerous events for various purposes, it is often captured in scenes seen on television or in photographs. Therefore, it would be desirous if one could use the prominent viewing position of this netting material as an advertising tool. Furthermore, advertising revenues for sport organizations and event organizers are often limited by the availability of useable space, thus it would also be beneficial if both sides of the netting material could be used for advertising purposes where it is feasible. Examples of where both sides of the net are visible to the audience include the sport of tennis and volleyball. Contrary to having signage suspended from a fence or a net, applying images directly onto a net will also not block the view of onlookers.

Environmental factors such as the rain and wind also are factors that may prove detrimental to the usage of signs at outdoor events. Thus, images applied directly to the netting could be an effective advertising tool; this effect could be rendered even more interesting due to the kinetic optical effect created when the netting moves.

In addition to advertising purposes, the present invention would also be useful for applying images onto nets for aesthetic reasons. Examples of this use may be found at playgrounds, amusement parks, and zoos.

Methods currently available to apply various types of designs onto mesh are known in the art. For example, a method for applying a colouring medium to only one side of a mesh screen is disclosed in U.S. Pat. No. 5,518,803. This patent, however, is limited to the application of regular commercial paints or inks with a compressed air gun onto a mesh consisting of thin solid filaments. A printing screen is positioned adjacent to the mesh materials, and the colouring medium is applied on the areas of the mesh which are exposed through the printing screen by spraying paint or ink. In this method, paint or ink is forced through the printing screen in a way that a detailed design is created on only one side of the mesh material. The method of this patent is directed largely towards insect or porch screens and the claims delineate the criteria of the printing screen (i.e., mesh count) and the air pressure of the spray gun. There are many reasons, however, why the method of this patent would not work to provide a durable design that could withstand the wear and tear that a net, such as a hockey or soccer net, regularly receives during a sports game.

The method of U.S. Pat. No. 5,518,803 is directed towards applying an image to mesh materials such as insect or porch screen, woven cloth, burlap, perforated plastic sheets and the like and thus is not appropriate for application to multi-filamentous mesh or nets such as those used in sporting events. Multi-filamentous mesh or nets pose a different set of problems due to the porous characteristic of the twine or rope used, and the requirement for the colour to withstand weathering and high force impacts.

As such, a need remains to overcome the difficulty which lies in the application of an effective colouring means to multi-filamentous nets or mesh of this nature.

To date, traditional compositions of a colouring means used on netting, mesh or the like has been unsuccessful due to their damaging effect on the strength of the fibres, and their inability to resist cracking, flaking or peeling under normal use as well as under extreme conditions.

It is important that any logo or image applied to a netting or mesh does not diffuse through the twine for several reasons. First, by restricting the image to one side of the netting or mesh, it will prevent the inversion of unidirectional logos. This would permit the full exploitation of the netting or mesh for advertising purposes since logos may be applied to both sides of the netting in situations where they are visible to the public.

Second, it is also necessary to have the image restricted to one side of the net or mesh to comply with sporting regulations that prohibit interfering with a judging official's clear view of a net as in the case of ice hockey. The colouring must be applied in such a manner so as to assure that only a small area of the twine is coloured while still providing full visual impact from the front. This would also minimize the image from being seen from the side when the net is moving.

Currently, traditional methods have proven unsuccessful in this regard given the absorptive nature of multi-filamentous twine normally used in most mesh or netting material.

Due to the above mentioned problems, mesh or netting material used for may public events have remained plain and devoid of any visual enhancement. There is, therefore, a need for a compound that will not compromise the integrity of the fibres nor cause the colours to diffuse uncontrollably. The colour must stay durable on the net even under harsh usage and environmental conditions. This would allow for the possibility of fully exploiting the net as a means of advertisement or decoration.

There is also a need for a method to apply the colouring means onto multi-filamentous nets that will result in consistently sharp and clear images that will be visible only from one side of the net even when it is moving. Finally, the method should be affordable and simple enough for an individual to perform with any size of netting.

SUMMARY OF THE INVENTION

The problems noted above have been overcome by using either a pigment formulation (either a paint or an ink combination of chemicals). The paint composition comprises of automotive basecoat paint, paint diluent and water, while the ink combination consists of ink, diluent and water. The pigment formulations, when applied in a certain manner coat half the circumference of the netting fibre (the front of the net) so the image will not be visible from the other side of the netting fibre (the back of the net), creating a durable image that will not diffuse through the fibres.

One object of the present invention is to provide a formulation that will result in a consistently durable image while retaining the pliable nature of the multi-filamentous mesh or net when used under normal as well as extreme conditions. This formulation will not damage the fibre which would limit the life expectancy of the mesh. This invention further provides both a paint and ink composition that will result in a durable image despite the netting undergoing numerous forceful impacts.

Another object of this invention is to provide a mode of application for the pigment formulation of this invention that will create an image on one side of the net material in such a manner that the colour will not be visible from the back.

Various other objects and advantages of the present invention will become apparent from the detailed description of the invention

DETAILED DESCRIPTION OF THE INVENTION

Because netting is often found in key areas at numerous public events, it is often captured in the background of photographs or viewed on television. The application of a logo onto the net will therefore result in powerful public exposure for advertisers.

The term "paint" means a fluid, with viscosity, drying time, and flowing properties dictated by formulation, normally consisting of a vehicle or binder, a pigment, a solvent or thinner, and a drier, which, following application, will change into a solid in time. This is contrasted to the term "ink", which means a dispersion of a pigment or a solution of a dye in a carrier vehicle yielding a fluid, paste, or powder to be applied to and 'dried' on a substrate through various means, for example, oxidation, evaporation, penetration, heat induced, catalyst induced, precipitation, polymerization, reacting with the printing substrate, gelling, cold-setting or quick-setting.

The term "extreme conditions" are defined to include harsh weathering and high force impacts from hockey pucks, baseball, sports equipment and various projectiles.

Numerous attempts have been conducted in attempt to develop an acceptable pigment formulation and a method for its application onto mesh, netting or fencing. Compositions used in these trials included various commercial dyes, latex, acrylic and alkali paints. These coloured mixtures were applied to the mesh or netting by way of a spray or a paint roller without any success. Thus, it was surprising to find that a composition of automotive base coat paint, paint diluent and water is very effective in creating durable images that will not diffuse uncontrollably through multi-filamentous mesh or net, and is superior to any product currently available on the market. Due to its normal use in the automotive industry, it is also surprising that this type of refinishing product proved effective as a means to create durable images onto multi-filamentous mesh or nets.

In addition to the paint combination, a novel ink composition was discovered that demonstrated the same characteristics. Similar to the above-mentioned paint composition, the ink mixture does not diffuse uncontrollably into the material resulting in a durable and bright image on multi-filamentous twine. It is clear that both colouring compositions are vastly superior to any product currently available on the market.

In addition to the novel pigment formulations, we have also discovered an effective method of applying this formulation onto multi-filamentous mesh, netting and fencing; the method of application is also essential to ensure a sharp, concentrated image.

The Paint Composition

Paint typically comprises three basic components: pigments, binders or resins, and solvents, as well as a few additives to correct any possible defects in the paint. Automotive paints differ from general household paints in the requirement of providing excellent corrosion resistance for the coated metal surface while providing the desired gloss and brightness for automobiles.

For this present invention, a paint composition is disclosed comprising any automotive basecoat paint, for example enamel or lacquer basecoat paint or colour coat having a pigmented polymer layer normally used prior to a clear coat during automotive refinishing in a suitable ratio of basecoat to diluent and water. The basecoat material comprises any suitable film forming material conventionally used in this art including acrylics, alkds, polyurethanes, polyesters and aminoplast resins. In addition to the pigments, commercial basecoats may also contain metallic or mica particles. Well known and useful automobile basecoats include products from DuPont, PPG, BASF, Glasurit, R-M, House of Kolor, Allchem, Berger Paints, Spics Hecker, Martin Senour as well as other paint manufacturers.

In addition to the pigment colour of the basecoat, further pigments may be added to the present invention. As a pigment colour, any of the inorganic or organic high-weather-resistant pigments which are commonly used in automotive basecoats can be successfully employed. Useful examples include inorganic pigments such as rutile type titanium dioxide, carbon black, etc. and such organic pigments as quinacridone pigments, (e.g. quinacridone red, etc.), azo pigments, (e.g. pigment red etc.), and phthalocyanine pigments, (e.g. phthalocyanine blue, phthalocyanine green etc.).

The diluent can be any appropriate paint solvent that is compatible with the basecoat to give a proper drying time. The chemical makeup of various diluent, although similar in design and purpose, varies according to the type of pigments and binders used in the particular paint products. As a common practice, thinners are designed to work with lacquer-based products, white reducers are used for enamel and urethane-based products. Equivalent products currently available on the market are easily obtained through automotive paint companies. When using the present paint composition on netting or mesh, the composition may approximately be composed of an appropriate and effective percentage by volume of a diluent. Factors that are known to affect the amount of diluent necessary to achieve the proper drying time include the humidity level, ambient temperature, and the thickness of the applied coat.

A range for the ratio of paint-to-diluent is between 75:25 to 60:40 volume:volume ("v:v") but is preferably a ratio of from 55:45 (v:v) to 45:65 (v:v). The most preferred ratio of paint-to-diluent is 50:50, the composition must set in a short period of time (approximately 5 minutes) so it will not bleed through the fibers or around the circumference of the netting material, extending the image to the opposite side of the net. It must not be so thick that it peels or flakes, especially upon impact. It must dry slow enough so that it has time to soak into the fiber, enabling it to withstand a large number of impacts without flaking or chipping away.

One preferred embodiment uses two commercially available products: Chromabase®, an automobile refinishing coating; and Basemaker® 7185S, a slow acting diluent. Both products are readily available from DuPont Company.

The Ink Composition

The variety of printing ink is numerous and can be classified by various means. Examples of recognized classifications include composition and texture, application and use, and drying maimer. Generally, inks are composed of colouring, a binder or vehicle, and drying agents. For the present invention, a dye-based ink composition is disclosed comprising any type of printing ink in an appropriate and effective ratio (by volume) of ink to a proper diluent and water. Non-limiting examples of possible inks for the present invention include fluorescent, Pantone base, Halftone process or regular colours.

The diluent can be any appropriate solvent that is compatible with the ink mixture to give a proper drying time. Equivalent products currently available on the market are easily obtained through ink manufacturers. When using the present ink composition on synthetic fabric, the volume of the diluent may vary according to several factors including the level of humidity, the ambient temperature and the thickness of the applied coating. It is desirable for the ink mixture to have a curing time of approximately 30 minutes. The formulation must set in a short period, so it will not bleed through the fibres or around the circumference of the netting material, extending the image to the opposite side of the net. It must not be so thick that it peels or flakes, especially upon impact. It must dry slow enough so that it has time to soak into the fibre, enabling it to withstand a large number of impacts without flaking or chipping away.

One preferred embodiment uses two commercially available products: HOMASCO®, a multi-usage ink; and HOMASCO® Regular Solvent, a medium acting diluent. Both products are commercially available from suppliers of printing inks.

The Mesh, Net or Fence Surface

The pigment formulation may be applied to a number of net or mesh-like surfaces. The term "net" means a fabric made from string, cord, etc, loosely knotted or woven in an openwork pattern. The term "mesh" means a fabric of thread, cord, wire, etc. knitted, knotted, or woven in an open texture with holes. In both cases, the mesh or net can be made from natural or synthetic materials with variations in the size of openings and in the diameter of the thread, cord, wire, etc. used for the mesh or net.

High tensile strength mesh or net structures often used in commercial applications are produced from either wire, synthetic or vegetable fibres. Several non-limiting examples of synthetic materials used for this purpose include nylon, and polypropylene yarn. Vegetable yarns include cotton, hemp, or other suitable materials.

There are numerous examples of mesh or netting being used at sporting events. Some common examples include: volleyball and tennis nets; goal-nets for hockey, water-polo, soccer, and lacrosse; mesh barriers to delineate the playing field or race course in skiing, jai-lai, running, cycling and automobile events; protective-netting such as the back-stop behind goal posts at a football field, behind the home plate of baseball diamonds, and above indoor squash or racketball courts; or wherever netting or mesh is used at a sporting event.

Multi-filamentous netting, especially those used in professional sporting events, are typically hand knotted to ensure that the knots are properly aligned to meet sports regulations. In the case of hockey, the goal nets are all quite individualistic in that each net is hand knotted and individually fitted with the proper tension onto the goal posts before each game. Once removed from its support, the netting loses its form and cannot be placed back into its exact form.

Netting or mesh is also commonly found at different public events. Examples include public and private locations such as commercial businesses, promotional sporting games tie-ins, amusement parks, zoos, parks, swimming pools, circuses, etc. In this type of application, nets such as the netting behind batting cages, at the end of golf driving ranges or climbing walls are typical useful examples.

The Method of Applying the Pigment Formulation

The method of application, which is by the free-hand application of the pigment formulation, is the same for both the paint or the ink composition. Due to the ease at which the netting may be crushed or deformed, it is not possible to apply the paint mechanically. Examples of manual application methods include the use of a paint roller, sponges, brushes and other means well known to those in the art of paint application.

The outline of the image may be imposed onto the mesh, or netting material in one of two fashions. The first is by way of a prepared stencil, which is affixed onto the net in the correct position before applying the paint or ink by the appropriate method. A second method is by projecting the image to be created onto the mesh or netting with a projector and manually tracing an outline with a felt-tipped marker, paint brush, ink applicator or other applicators that are well known to those skilled in the art. In the latter case, it is critical that the line art be accurately drawn so as to ensure the proper reproduction of the untended image or logo.

Due to how the netting material is stretched onto the goal posts for each game, it is necessary to apply the pigment formulation in a vertical position only after the net has been set up to ensure the applied image remains undistorted. The method of the present invention is conducted with a paint roller having a dense sponge applicator of various sizes, or with other appropriate applicators known to those skilled in the art. After the sponge applicator is properly saturated with the colouring mixture, any excess paint is removed from the applicator before the colour is applied to the mesh or netting. To ensure sharp clear images, the colouring mixture is applied in a quick fashion to prevent any paint from dripping onto the sides of the twine. The colouring mixture is allowed to dry for a minimum of five minutes following each application to ensure proper absorption into the mesh or net surface. A minimum of two coats of the colouring mixture is used to create an image on the mesh or netting.

Following the application of the image onto the netting material, the net is placed at its position on the playing field to verity the integrity of the image at the proper angles.

Positioning of the Image on the Mesh, or Netting Material

The most effective positions for applying the images onto the netting material are determined by analysing all possible views from any known positions of the television cameras. The images are placed to achieve maximum visual impact during any televised broadcasts of the event.

To further assist in understanding the present invention, the following non-limiting examples of the use of the coloured means on multi-filamentous mesh or twine is provided. These examples, of course, should not be construed as specifically limiting the present invention. Variations presently known or later develop, which would be within the purview of one skilled in the art, are considered to fall within the scope of the present invention as described herein.

Representative Applications

The present invention may be beneficial in numerous applications. In the case of hockey, it is essential that any images applied to the goal net do not diffuse through the twine. Contrary to most other sports, hockey regulations stipulate that the back of a hockey net must remain white to ensure a goal judge's full visibility of the puck inside the net. In light of this, the present invention will not inhibit the goal judge's view while providing effective media exposure for the advertiser. Furthermore, given the full visibility of the net during a televised game, it will also be possible to apply images on top of the hockey nets using the present invention.

At events where large sheets of mesh or netting is used, for example, behind the goal posts in football games or behind the home plate in baseball games, the present invention may permit the creation of large images onto the multi-filamentous mesh or netting.

Furthermore, where both sides of the mesh or netting is visible to the public, like in the case of volleyball, badminton or table tennis games, the present invention would permit images or logos to be placed on both sides of the mesh or netting. This would effectively double the permissible advertising space for the event organizers.

Non-sporting organizations would also benefit from the present invention. Netting is commonly used on numerous occasions for both security and aesthetic reasons at various business enterprises. Amusement parks, batting cages, indoor golf driving ranges, and retail stores are just several examples of where multi-filamentous mesh or netting has been used.

Multi-filamentous mesh or netting is also used for practical reasons at animal enclosures or zoos. In the case of zoos, it is now quite common to locate birds in large enclosures to ensure there is adequate space for the birds to fly. In this regard, mesh or netting is often used as an inexpensive means to create a closed structure while also ensuring the safety of the birds if they were to fly into the net. An additional practical application for the present invention may be to create images onto the mesh or twine to create an illusion of a forest or sky in order to provide a less stressful environment for the animals.

Advantages of the Invention

When used to apply images onto multi-filamentous mesh or netting, the present invention has several advantages over the prior art.

Contrary to existing pigment formulations, the application of the present invention onto multi-filamentous mesh or nets will not diffuse uncontrollably into the filaments nor will it weaken its durability or suppleness while maintaining its colours under normal and extreme conditions.

The present invention will not inhibit the view of spectators situated behind the decorated area nor will it render the signage susceptible to the wind.

Application of images on a background that is constantly moving will further enhance its effectiveness by transforming traditional 'passive advertising' to a more active form.

The present method of application is affordable and simple enough for individuals to perform on various sized mesh or netting.

EXAMPLE 1

The Application of Images or Logos onto Hockey Nets Using the Paint Composition A colouring mixture was prepared by mechanically mixing equal amounts of the basecoat with the proper paint diluent for five minutes. To this mix, add further pigments if required and shake for an additional five minutes. Following this, add 25 milliliters of water per liter of mixture and mechanically mixed for another 10 minutes before filtering the mixture to remove any excess solids.

This final colouring mixture is then poured into a paint tray and gently mixed with water at a two-to-one ratio by volume. The mixture is allowed to sit until a water layer forms on top of the paint before it is applied to the hockey net. It is important to ensure that the paint roller is sufficiently saturated with the paint-water mixture.

Prior to applying the colouring mixture to the net, an outline of the image or the corporate sponsor's logo to be used may be created in two possible ways. The first is by adhering a prepared stencil of the image or logo onto the hockey net before applying the pigment formulation. The second method is by projecting the image or the logo onto the hockey net and tracing its outline with a felt-tipped marker or the like. The precise location to assure maximum public exposure for the image or logo during a televised game is determined by analysing common camera positions as seen from official National Hockey League videos.

The colouring mixture is applied to the prepared outline on the hockey net in several steps. Maintaining the net in a vertical position, the border of the outline is then delineated with tape or the like to ensure only the correct areas are coloured. The colouring mixture is applied to the net using a paint roller with a dense synthetic sponge applicator. The paint roller is throughly saturated with the colouring mixture. After making sure that any excess colouring mixture is removed by scraping the roller along the edge of the paint tray, the colouring mixture is applied by quickly rolling the colour over the proper areas. The colouring is allowed to dry on the net for a minimum of five minutes following each application. Two coats of the colouring mixture is applied to the net.

EXAMPLE 2

The Testing of the Paint Compositions to Withstand Numerous High Force Impacts To demonstrate its durability, the image or logo applied onto a hockey net using the present invention was subject to high impact forces normally associated with the game of hockey. The test consisted of subjecting the coloured areas to the force of numerous pucks shot at high speeds. Despite the numerous forceful impacts of the pucks, the colours of the painted image remained intact and vibrant. There was also no apparent detrimental effect on the strength of the twine due to the colouring mixture. These test results clearly show that the present invention is superior to any commercial product currently available on the market when used on multi-filamentous mesh or nets.

From the foregoing descriptions, one skilled in the art can easily ascertain the essential characteristics of this invention, and without departing from the spirit and scope thereof, can make various changes and modifications of the invention to adapt it to various usages and conditions. Consequently, such changes and modifications are properly, and equitably 'intended' to be within the full range of equivalence of the following claims.

EXAMPLE 3

The Application of Images or Logos onto Hockey Nets Using the Ink Composition A colouring mixture was prepared by mechanically mixing equal amounts of the ink with the proper diluent for five minutes. To this mix, add further pigments if required and shake for an additional five minutes. Following this, add 25 milliliters of water per liter of mixture and mechanically mixed for another 10 minutes before filtering the mixture to remove any excess solids.

The final colouring mixture is then poured into a paint tray and gently mixed with water at a two-to-one ratio by volume. The mixture is allowed to sit until a water layer forms on top of the ink composition before it is applied to the hockey net. It is important to ensure that the paint roller is sufficiently saturated with the ink-water mixture.

Prior to applying the colouring mixture to the net, an outline of the image or the corporate sponsor's logo to be used may be created in two possible ways. The first is by adhering a prepared stencil of the image or logo onto the hockey net before applying the pigment formulation. The second method is by projecting the image or the logo onto the hockey net and tracing its outline with a felt-tipped marker or the like. The precise location to assure maximum public exposure for the image or logo during a televised game is determined by analysing common camera positions as seen from official National Hockey League videos.

The ink composition is applied to the prepared outline on the hockey net in several steps. Maintaining the net in a vertical position, the border of the outline is then delineated with tape or the like to ensure only the correct areas are coloured. The colouring mixture is applied to the net using a paint roller with a dense synthetic sponge applicator. The paint roller is throughly saturated with the colouring mixture. After making sure that any excess colouring mixture is removed by scraping the roller along the edge of the paint tray, the colouring mixture is applied by quickly rolling the colour over the proper areas. The colouring is allowed to dry on the net for a minimum of five minutes following each application. Two coats of the colouring mixture is applied to the net.

What is claimed:

1. A method of impregnating a multi-filamentous net or mesh with a pigment formulation to generate a sharp image comprising the steps of:

a) determining a primary viewpoint for said net wherein an observer would be able to view a sharp image on the net surface and a secondary viewpoint for said net or mesh wherein an observer would be unable to see said image;

b) tracing an outline of an image onto the mesh or net to generate an outline of an image that would be visible from said primary viewpoint and not visible from said secondary viewpoint; and c) applying the pigment formulation on and within said outline free-hand with a paint roller having a sponge applicator such that a pigment formulation is impregnated and absorbed into said multi-filamentous net or mesh, wherein said pigment formulation is comprised of (a) automotive paint intended for metal surfaces, or (b) ink, and (c) a diluent and water, mixed in a ratio that results in a formulation saturated with water demonstrating the following characteristics:

i) the formulation absorbs into a net fibre;

ii) the formulation does not bleed through or around the net fibre such that it can be seen from the secondary viewpoint;

iii) a clears, crisp image is formed that can be seen from the primary viewpoint;

iv) the formulation does not harm the physical integrity of a net fibre;

v) the formulation does not affect the matrix geometry of the net; and vi) said image, once impregnated into said multi-filamentous net or mesh, does not block the view of an observer at said secondary viewpoint.

2. A method as in claim 1 wherein the step of tracing an outline of an image is conducted using a stencil or mask.

3. A method as in claim 1 wherein the step of tracing an outline of an image is conducted using a projected image.

4. A multi-filamentous net or mesh material having an image on one side thereof whereby the image is formed from a pigment formulation comprising (a) automotive paint or ink and (b) a diluent, and wherein said multi-filamentous net or mesh is impregnated with said pigment formulation according to the method of claim 1.

5. A multi-filamentous net or mesh material having an image on one side thereof according to claim 4 wherein the ratio of automotive paint or ink to the diluent is in the range of 75:25 v:v to 40:60 v:v.

6. A multi-filamentous net or mesh material having an image on one side thereof according to claim 5 wherein, the ratio of automotive paint or ink to the diluent is in the range of 55:45 v:v to 45:65 v:v.

7. A multi-filamentous net or mesh as in claim 4, wherein said net or mesh is for use at a sporting event selected from the group consisting of volleyball, tennis, hockey, water-polo, soccer, lacrosse, skiing, jai-lai, running, cycling, automobile racing, motorcycle racing, football, baseball, squash, and racquetball.

8. A multi-filamentous net or mesh as in claim 4, wherein said net or mesh is for use at a public or private location selected from the group consisting of a commercial business location, an amusement park, a zoo, a park, a swimming pool, a circus, a driving range on a golf course, a batting cage in a recreational facility, and a climbing wall at a recreational facility.

* * * * *

UNITED STATES PATENT AND TRADEMARK OFFICE

CERTIFICATE OF CORRECTION

PATENT NO. : 6,986,915 B2
APPLICATION NO. : 09/904044
DATED : January 17, 2006
INVENTOR(S) : Mr. Richard Bourdages It is certified that error appears in the above-identified patent and that said Letters Patent is hereby corrected as shown below:

Referencs Cited:

U.S. 4,547,406: change date to --10/1986--

Claims:

Claim 1 (col. 10, line 24): replace “clears” with --clear--

Signed and Sealed this

Fourth Day of September, 2007

JON W. DUDAS
*Director of the United States Patent and Trademark Office*